United States Patent [19]

LoFiego

[11] Patent Number: 4,480,551

[45] Date of Patent: Nov. 6, 1984

[54] POINT-DETONATING VARIABLE TIME-DELAYED FUZE

[75] Inventor: Louis LoFiego, Chatsworth, Calif.

[73] Assignee: Whittaker Corporation, Los Angeles, Calif.

[21] Appl. No.: 502,403

[22] Filed: Jun. 8, 1983

[51] Int. Cl.[3] ..... F42C 1/10; F42C 15/22

[52] U.S. Cl. ..... 102/245; 102/272

[58] Field of Search ..... 102/244, 245, 269, 272, 102/273, 275, 237, 222

[56] References Cited

U.S. PATENT DOCUMENTS

| | | | |
|---|---|---|---|
| 2,808,000 | 10/1957 | Lindsey | 102/272 X |
| 2,850,980 | 9/1958 | Stevenson et al. | 102/245 X |
| 3,119,336 | 1/1964 | Hjelm | 102/245 |
| 3,421,443 | 1/1969 | Furlani | 102/245 |
| 4,004,521 | 1/1977 | Andrejkovics | 102/273 X |
| 4,013,013 | 3/1977 | Davis | 102/275 |
| 4,237,788 | 12/1980 | Hagen | 102/275 |

FOREIGN PATENT DOCUMENTS

| | | | |
|---|---|---|---|
| 1077575 | 3/1960 | Fed. Rep. of Germany | 102/244 |
| 1555603 | 12/1957 | France | 102/244 |

*Primary Examiner*—David H. Brown

*Attorney, Agent, or Firm*—Donald E. Nist

[57] ABSTRACT

The fuze comprises a fuze body having a readily crushable nose cone and a thermal initiator, a thermally ignitable flash detonator and a main charge of booster explosive disposed in sequence in the body. The thermal initiator includes a cup having a closed front end and an open rear end closed by a non-metallic, thermally destructive closure. A readily thermally ignitable, incendiary, exothermic chemical material is disposed in the cup, and the cup is fixed in the nose. Rearward of the cup a rotor ball is disposed in the fuze, which rotor ball contains the detonator. A C-spring connects the rotor ball to the fuze body and maintains the rotor ball in an orientation such that the detonator in the rotor ball is out of alignment with the initiator except when the fuze is spinning beyond the gun barrel as when it is connected to a fired projectile. The detonator includes a cup having a closed thermal barrier alignable with the rear end of the initiator cup, and a thermally destructive closure on the opposite end. A primary explosive material is disposed in the detonator cup next to the thermal barrier, and a minor charge of booster explosive is in the cup adjacent the primary explosive. A main charge of booster explosive is disposed in the rear end of the fuze body adjacent the rotor ball. Rotation of the rotor ball during firing aligns the minor charge to the main charge.

9 Claims, 7 Drawing Figures

POINT-DETONATING VARIABLE TIME-DELAYED FUZE

BACKGROUND OF THE INVENTION

1. Field of the Invention

The present invention generally relates to fuzes and more particularly to an improved time-delayed fuze for a projectile.

2. Prior Art

Current military projectiles in the 20–30 millimeter range commonly employ a point-detonating fuze which includes an initiator in the form of a firing pin disposed in a crushable nose cap. When a projectile having such a fuze strikes a target, the nose is crushed, causing the firing pin to be forced rearwardly into a detonator which detonates and in turn detonates a main booster explosive charge in the rear of the fuze. Unfortunately, if the nose of the fuze strikes the target at an oblique angle of more than 20° to the projectile's flight path, the fuze may not operate. Thus, the nose cap will crush but will not exert a side force on the firing pin so as to prevent it from moving rearwardly to cause the detonator to detonate.

Since a very large number of rounds of ammunition of the size range indicated are supplied to the military annually and would be used extensively in a conflict, it would not only be desirable to provide a more efficient point detonating fuze for the ammunition, but also to improve the cost effectiveness of such a fuze.

It would also be of importance to be able to accurately control the time delay between the time of impact and the time when the main booster charge in the fuze is set off. This would allow the ammunition to more fully penetrate the target before exploding for improved effectiveness. Although there are various time-delay means for time-delay fuzes, most such means are relatively complicated, bulky and/or expensive. An efficient inexpensive time-delay means readily includable in a fuze of the type described would represent a substantial improvement in the art.

SUMMARY OF THE INVENTION

The improved point-detonation, variable time-delay fuze of the present invention satisfies all the foregoing needs. The fuze is usable in projectiles of various sizes, such as those of the 20–30 millimeter size range, and is capable of being easily fabricated with a variable time delay built into the fuze. Of more importance, the fuze reliably detonates upon contact with the target, at very low angles at which the projectile strikes the target. The fuze includes components which assure that it does not prematurely detonate. Thus, it is only capable of detonating when the detonator in the fuze is in line with both the initiator and the main booster explosive charge. This can only occur when the projectile containing the fuze is fired and leaves the gun barrel.

The fuze includes a fuze body of metal or the like having a front crushable nose cone or cap of metal or the like in which is disposed a thermal initiator comprising a cup with a closed front end and open rear end sealed by a non-metallic closure. The thermal initiator contains a charge of readily ignitable, incendiary, exothermic chemical material which ignites when the nose cone is crushed upon contact with the target, causing a blast of heat to eject from the rear of the cup and impinge upon a flash detonator in a rotor ball disposed just to the rear of the initiator. The flash detonator includes a cup having a closed thermal barrier and the opposite end of which is closed by a disc.

The primary explosive is disposed in the detonator cup adjacent the thermal barrier and a minor charge of booster explosive is disposed in the cup between the primary explosive and the rear end of the cup. The rotor ball is held in the fuze body by a C-shaped spring so that the detonator is out of alignment with the initiator until firing, when the spin imparted to the projectile containing the fuze overcomes the spring force and causes the detonator to align behind the initiator and in front of the main booster explosive charge in the fuze after leaving the gun barrel. The detonator is in this position when the fuze strikes the target so that the thermal flash from the initiator impinges upon the thermal barrier end of the detonator causing the detonator to detonate after a controlled time delay. The primary explosive in the detonator detonates first, followed by the minor booster explosive which causes the main charge of booster explosive to detonate. Thus, a built-in safety factor is provided in the fuze against premature ignition and detonation of the fuze. Various other features of the present invention are set forth in the following detailed description and accompanying drawings.

DRAWINGS

DETAILED DESCRIPTION

Figure 1:
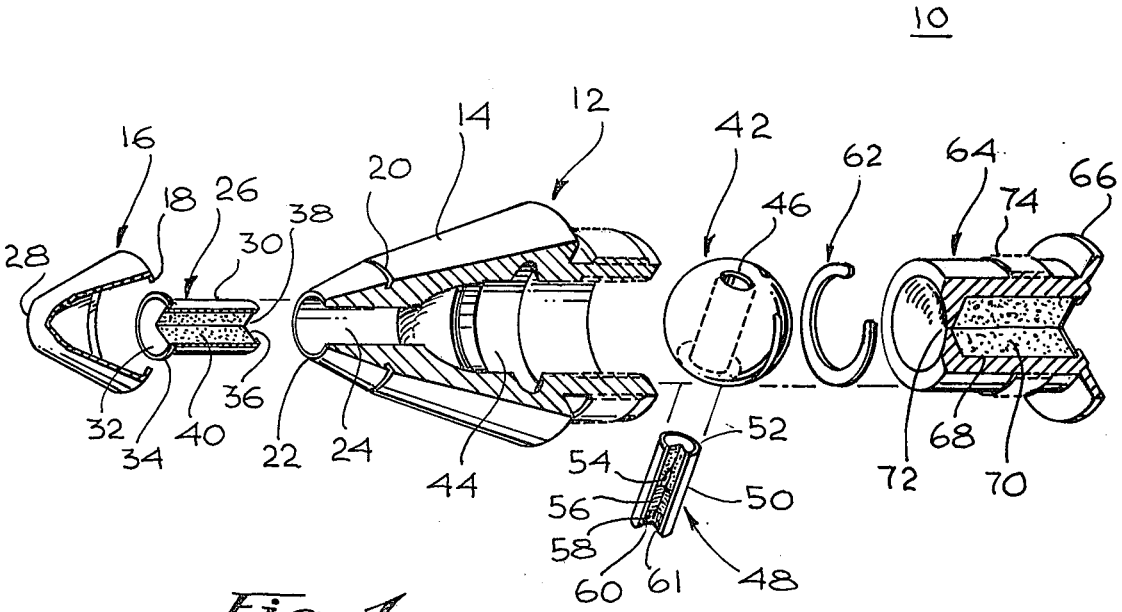
FIG. 1 is a schematic exploded perspective view of a first preferred embodiment of the improved fuze of the present invention.
Figure 2:
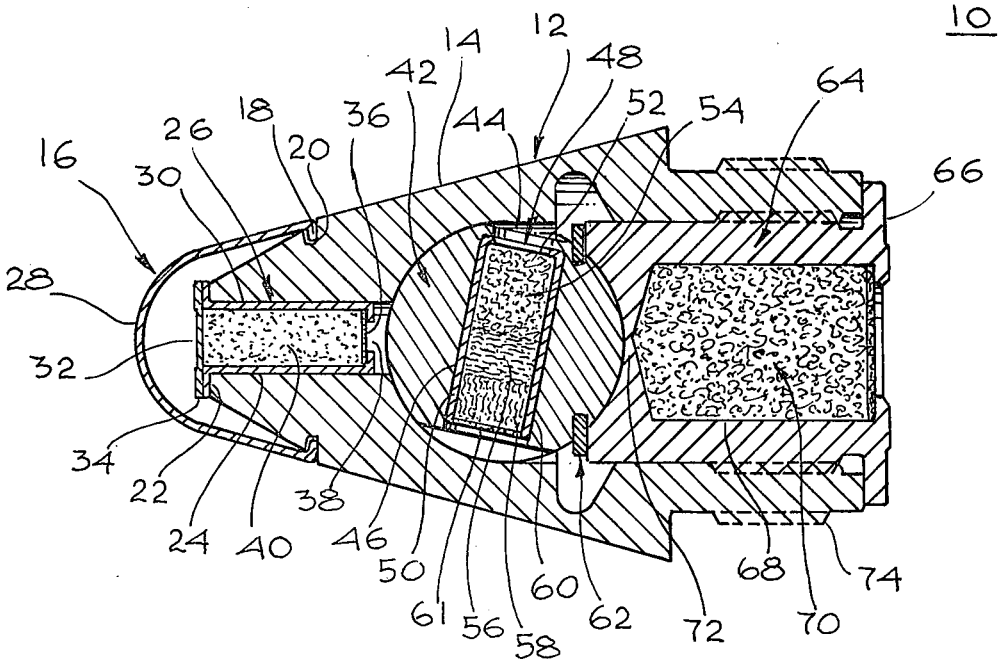
FIG. 2 is a schematic cross section of the fuze of FIG. 1.

FIGS. 1 and 2

A first preferred embodiment of the improved point detonating variable time-delayed fuze invention is schematically set forth in FIGS. 1 and 2. Thus, fuze 10 is shown which comprises a fuze body 12 which may be of metal, plastic or the like, is generally cylindrical, and which includes a generally conical front portion 14 bearing a generally conical, thin, readily crushable front nose 16. Nose 16 may be of thin aluminum, low carbon steel or the like and may include an inwardly directed rear flange 18 which seats in a groove 20 in portion 14.

The front end 22 of portion 14 has a central rearwardly directed cylindrical cavity 24 disposed therein, in which is seated initiator 26. The front end 28 of nose 16 is spaced forwardly of initiator 26, as shown particularly in FIG. 2.

Initiator 26 includes a cylindrical cup 30 of metal, plastic or the like, preferably aluminum. Cup 30 has a closed front end 32, bearing a peripheral flange 34 which seats against front end 22, and an open rear end 36 closed by a readily thermally destructible non-metallic closure disk of plastic, paper, thin wood or the like. Cup 30 is filled with a suitable, readily ignitable, incendiary exothermic chemical material 40 which may be, for example, a mixture of a fuel such as a metal powder, for example, magnesium, aluminum, zirconium, titanium, or iron; an oxidizer, for example, potassium chlorate, potassium perchlorate, sodium nitrate, iron oxide, lead dioxide or a fluorocarbon; and in some instances other additives. The mixture may be loosely filled into cup 30 or be press packed into position.

Rotor ball 42, which may be spherical or the like, and preferably is of metal such as aluminum, steel or the like, is disposed in a cavity 44 in fuze body 12 immediately behind initiator 26, cavities 24 and 44 being in communication, as shown in FIG. 2. Rotor ball 44 has a passageway 46 therein in which is seated detonator 48. Passageway 46 spans rotor ball 42. Detonator 48 comprises a cup 50 of aluminum, steel, plastic, or the like and which is generally cylindrical. End 52 of cup 50 is closed to form a thermal barrier, the thickness and nature of which can be varied to control the time delay imparted to fuze 10. In addition, a thermally insulative layer 54 can be disposed inside cup 50 against end 52 to further control the time delay for fuze 10. Primary explosive such as lead azide or lead styphnate is disposed as a layer 56 in cup 50 against the downstream end of layer 54. Layer 56 is followed by a minor charge 58 of booster explosive in the downstream end 60 of cup 50 which is sealed by a thin closure 61. That booster explosive may be any suitable one, for example, conventional explosives such as Tetryl, RDX, PETN, HMX or HNS.

A C-shaped spring 62 holds the rotor ball 42 in a resting position in body 12 so that detonator 48 is transverse of the longitudinal axis of fuze body 12 in the resting or storage position. However, when fuze 10 is connected to a projectile and the projectile is fired to impart a spin thereto, the spin overcomes the retaining action of spring 62, thereby permitting the rotor ball 44, after leaving the bore of the gun, to rotate into a position such that detonator 48 is aligned along the longitudinal axis of body 12 with end 52 adjacent rear end 36 of initiator 26. End 60 of cup 50 while in that position is also immediately adjacent to a fitting 64 disposed in the rear end 66 of body 12, which fitting 64 contains a cavity 68 filled with the main charge 70 of booster explosive. Fitting 64 is generally cylindrical and is screwed into place in body 12. A front thin partition 72 in fitting 64 separates rotor ball 42 and detonator 48 from main booster charge 70. Detonation of detonator 48 causes disruption of partition 72 and detonation of main booster charge 70. As can be seen in FIGS. 1 and 2, rear end 66 of body 12 may be provided with external threads 74 so that a fuze 10 can be screwed into position on the front end of a projectile (not shown).

When fuze 10 is attached to the front end of a projectile, such as a 20 millimeter shell and is fired, as indicated above, the spin imparted to the projectile causes alignment of detonator 48 with both initiator 26 and main booster charge 70. When the projectile reaches the target, nose 16 impacts first and is crushed, generating sufficient heat to ignite initiator 26 even at low angles of strike of nose 16 with such target. In contrast, fuzes which depend upon rearward displacement of firing pins by front nose crushing malfunction when the nose strikes the target at an oblique angle of, for example, 30° or more. Under such circumstances, the firing pin is not moved rearward but instead is torqued sideways and jammed and the fuze fails to operate. Fuze 10 fires when nose 16 is crushed against the target subsequent to arming. The ignited initiator 26 causes detonation of detonator 48 which, in turn, detonates main booster charge 70. The time required for this chain of events to take place can be controlled by selecting a desired thickness of thermal layer 54 in detonator cup 50 and/or by varying the thickness of the upstream end 52 of cup 50 and/or the density of initiator composition 40. In contrast, conventional fuzes normally employ more complicated time-delay mechanisms. Rotor ball 42 with spring 62 hold detonator 48 out of alignment with initiator 26 and charge 70 until firing and thus assure that fuze 10 can be safely stored, shipped and installed without premature firing. Fuze 10, therefore, has the necessary safety features as well as improved performance.

FIG. 3

Figure 3:
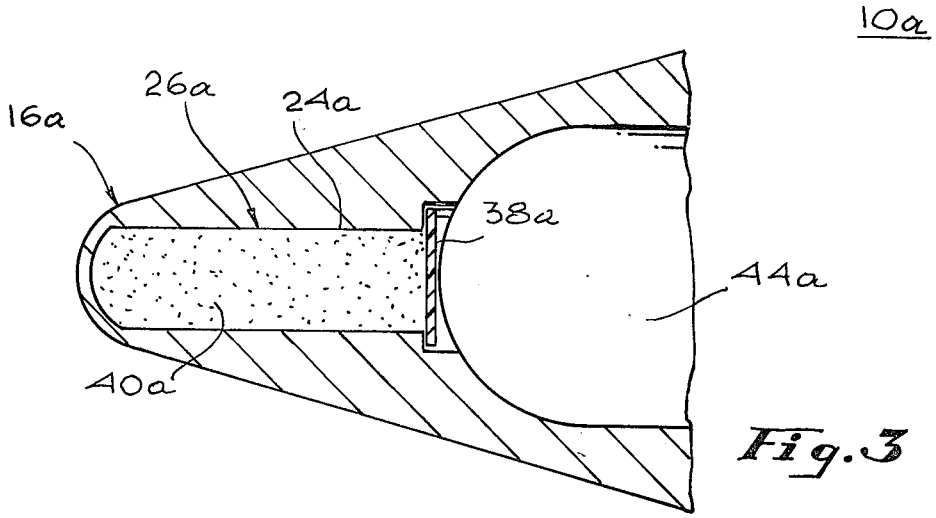
FIG. 3 is a schematic cross section of a second preferred embodiment of the nose and initiator portions of the improved fuze of the present invention.

A second preferred embodiment of the fuze of the present invention is schematically depicted in FIG. 3. Thus, fuze **10*a* is shown. Components thereof similar to those of fuze 10 bear the same numerals but are succeeded by the letter "a". A readily crushable nose 16*a* is shown in cross section in FIG. 3, which nose 16*a* includes an elongated generally cylindrical cavity 24*a* in which an initiator 26*a* is disposed comprising initiator material 40*a*. Cavity 24*a* is separated from a generally spherical cavity 44*a* by a rear closure 38*a* of readily thermally frangible and/or consumable non-metallic material such as paper, plastic, or the like. Cavity 44*a* may contain a shell similar to shell 42 containing a detonator similar to detonator 48. The remainder of fuze 10*a* is identical to the remaining components of fuze 10 of FIGS. 1 and 2. It will be understood that nose 16*a*, which is generally conical, is equivalent to nose 16 plus front end 22 of fuze 10. It will be noted that cavity 24*a* is sufficiently elongated so that initiator 26*a* can be readily thermally initiated at very low angles at which nose 16*a* strikes a target. Fuze 10*a* can be fabricated of components similar to those of fuze 10**.

FIG. 4

Figure 4:
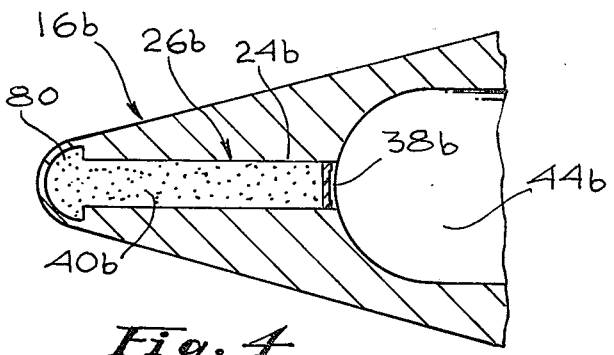
FIG. 4 is a third preferred embodiment of the nose and initiator portions of the improved fuze of the present invention.

A third preferred embodiment of the improved fuze of the present invention is schematically depicted in FIG. 4. Thus, fuze **10*b* is shown. Components of fuze 10*b*, similar to those of fuze 10 and/or fuze 10*a*, bear the same numerals but are succeeded by the letter "b". In FIG. 4, only the front portion of fuze 10*b* is shown. All components not shown are identical with those of fuze 10. Nose 16*b* is illustrated and is similar to nose 16*a*. Nose 16*b* includes a central rearwardly extending cavity 24*b* having an expanded, rounded head 80. An initiator 26*b* is disposed in cavity 24*b* and comprises readily thermally ignitable material 40*b* held in cavity 24*b* by a rear end closure 38*b*. Closure 38*b* is exposed to cylindrical cavity 44*b* immediately therebehind. Accordingly, crushing of nose 16*b* thermally ignites initiator 26*b* which opens closure 38*b*, allowing thermal impingement on a detonator (not shown), such as detonator 48 disposed in a rotor ball (not shown), such as rotor ball 42 in cavity 44*b*. The elongated nature of initiator 26*b*, including its expanded head 80, assures thermal initiation thereof at very low angles of strike of nose 16*b***.

FIG. 5

Figure 5:
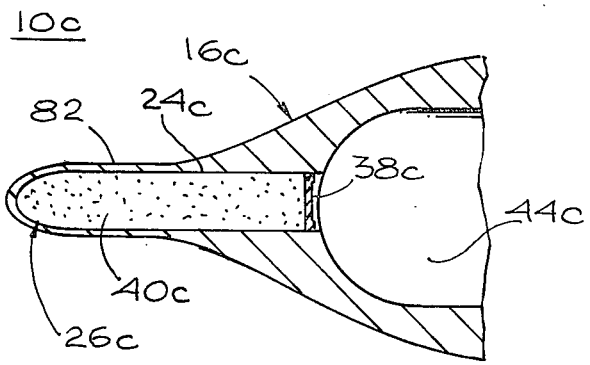
FIG. 5 is a fourth preferred embodiment of the nose and initiator portions of the improved fuze of the present invention.

A fourth preferred embodiment of the improved fuze of the present invention is schematically illustrated in FIG. 5. Thus, fuze 10c is shown. Components thereof, which are similar to those of fuze 10, 10a and/or 10b, bear the same numerals but are succeeded by the letter "c". Components of fuze 10c, not shown in FIG. 5, are identical with those of fuze 10. The front portion of fuze 10c is shown and comprises a nose 16c, which is tapered down to a thin elongated front portion 82. Nose 16c has a cavity 24c extending from portion 82 to the rear end thereof, which cavity is generally cylindrical and in which is disposed an initiator 26c comprising a body 40c of thermally ignitable material held in cavity 24c by a rear closure 38c. Closure 38c is exposed to cylindrical cavity 44c immediately therebehind. Nose 16c has the advantages of noses 16a and 16b, but provides to an even greater extent exposure of initiator 26c to thermal ignition upon contact of portion 82 with the target at any angle. As with noses 16a and 16b, nose 16c can be fabricated of any suitable material, such as thin low carbon steel, aluminum, etc. to provide the desired results.

FIG. 6

Figure 6:
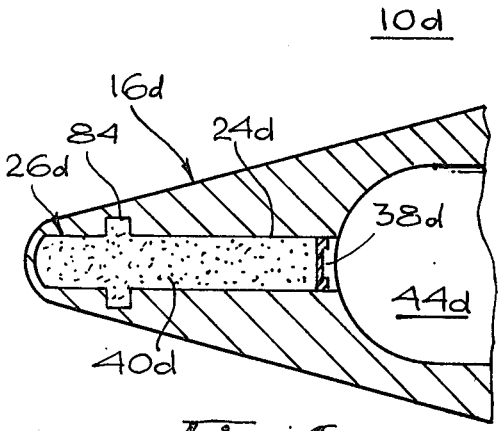
FIG. 6 is a fifth preferred embodiment of the nose and initiator portions of the improved fuze of the present invention; and, FIG. 7 is a sixth preferred embodiment of the nose and initiator portions of the improved fuze of the present invention.

A fifth preferred embodiment of the invention as schematically shown in FIG. 6. Thus, fuze 10d is depicted. Components thereof similar to those of fuze 10 bear the same numerals but are succeeded by the letter "d". Components of fuze 10d not shown in FIG. 6 are identical to those of fuze 10. The front portion of fuze 10d is shown and comprises a nose 16d. Nose 16d has a cylindrical cavity 24d extending rearwardly therethrough. Cavity 24d has an expanded portion 84 near the front end thereof and cavity 24d is filled with a thermally ignitable material 40d to form initiator 26d. Cavity 24d is closed at the rear end thereof by a closure 38d, which is exposed to cylindrical cavity 44d immediately therebehind. Fuze 10d performs in the manner previously described for fuzes 10a, 10b and 10c.

FIG. 7

Figure 7:
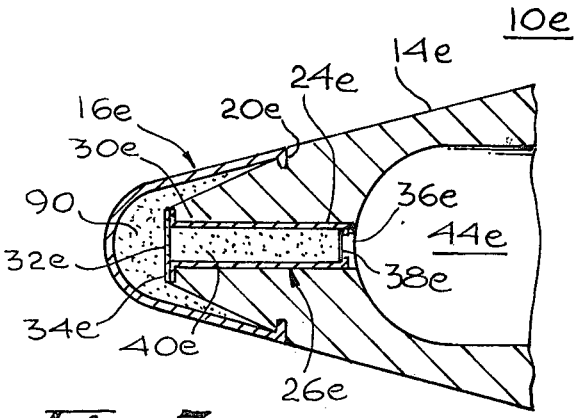

A sixth preferred embodiment of the invention is schematically shown in FIG. 7. Thus, fuze 10e is depicted. Components thereof similar to those of fuze 10 bear the same numerals but are succeeded by the letter "e". Components of fuze 10e not shown in fuze 7 are identical to those of fuze 10. The front portion of fuze 10e is shown and comprises a nose 16e connected by a rear groove 20e to the conical front portion 14e of fuze 10e. Portion 14e has a cavity 24e extending therethrough in which is disposed an initiator 26e which includes a nose 30e having a front flange 34e and an open rear end 36e closed by a closure 38e. Initiator 26e contains readily ignitable incendiary material 40e. There is also a body of the same material 40e present in a cavity 90 between nose 16e and portion 14e, as shown in FIG. 7. Closure 38e is exposed to a cavity 44e immediately therebehind. Crushing of nose 16e ignites material 40e in cavity 90 and in initiator 26e. Fuze 10e functions generally in the same manner as fuze 10.

Various other modifications, alterations, changes and additions can be made in the improved time-delay fuze of the present invention, and in its components and their parameters. All such modifications, alterations, changes and additions as are within the scope of the appended claims form part of the present invention.

What is claimed is:

1. An improved point-detonating, variable time-delayed fuze for projectiles, which fuze comprises, in combination:

a. a fuze body;

b. a readily crushable nose disposed at the front end of said body;

c. a thermal initiator disposed in said nose, said initiator including i. a cup having a closed front end and an open rear end closed by a non-metallic, thermally destructive closure; and, ii. a readily thermally ignitable, incendiary, exothermic chemical material disposed in said cup;

d. a rotor ball disposed in said body rearwardly of and and adjacent to said initiator;

e. a thermally ignitable flash detonator disposed in said rotor ball, said detonator including i. a cup having a closed thermal barrier end and an opposite end closed by a disk, ii. an insulating barrier material in said cup adjacent to said closed thermal barrier end, and iii. a primary explosive material in said cup adjacent to said insulating thermal barrier;

f. a main charge of booster explosive disposed in the rear end of said fuze body adjacent said rotor ball; and, g. biasing means connected to said rotor ball for maintaining said detonator out of alignment with said initiator and main booster explosive charge except during rapid rotation of said fuze upon firing of a projectile to which said fuze is attachable.

2. The improved fuze of claim 1 wherein said rotor ball is metallic and substantially spherical and wherein said biasing means comprises a C-shaped spring.

3. The improved fuze of claim 1 wherein said detonator cup includes a layer of thermally insulative material disposed between said closed cup end and said primary explosive to regulate the time delay for said fuze.

4. The improved fuze of claim 1 wherein said initiator composition is of a preselected density to regulate the time delay for said fuze.

5. The improved fuze of claim 1 wherein said nose cap comprises low carbon steel, said rotor ball comprises stainless steel, said detonator cup comprises aluminum, said main fuze body comprises steel and wherein the main booster charge is in a steel holder in said fuze body.

6. The improved detonator of claim 5 wherein said initiator cup comprises aluminum, wherein said primary explosive comprises lead azide and wherein said booster explosive in said detonator cup comprises HMX.

7. The improved fuze of claim 1 wherein said initiator cup has a front flange which fixes the position of said cup in said front nose.

8. The improved fuze of claim 7 wherein said initiator cup is metal and said cup closure is selected from the group consisting of plastic and paper.

9. The improved fuze of claim 8 wherein said exothermic chemical material comprises a mixture of powdered metallic fuel, an oxidizer, and additives.

* * * * *